US009124993B2

(12) United States Patent
Kilsgaard

(10) Patent No.: US 9,124,993 B2
(45) Date of Patent: Sep. 1, 2015

(54) HEARING AID WITH A WIRELESS TRANSCEIVER AND METHOD OF FITTING A HEARING AID

(71) Applicant: Widex A/S, Lynge (DK)

(72) Inventor: Soren Kilsgaard, Smorum (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 14/099,216

(22) Filed: Dec. 6, 2013

(65) Prior Publication Data

US 2014/0093110 A1 Apr. 3, 2014

Related U.S. Application Data

(63) Continuation-in-part of application No. PCT/EP2011/060087, filed on Jun. 17, 2011.

(51) Int. Cl.
*H04R 25/00* (2006.01)

(52) U.S. Cl.
CPC ..... *H04R 25/554* (2013.01); *H04R 25/00* (2013.01)

(58) Field of Classification Search
CPC ..... H04R 25/00; H04R 25/55; H04R 25/558; H04R 25/605; H04R 2225/31; H04R 2225/33; H04R 2460/13; H04R 1/105; H04R 2225/021; H04R 2225/63
USPC ..... 381/312, 314–316, 323, 326, 330–331
See application file for complete search history.

(56) References Cited

U.S. PATENT DOCUMENTS 7,292,698 B2 * 11/2007 Niederdrank et al. ..... 381/315
8,306,489 B2 * 11/2012 Schwarzmueller et al. .. 455/123
2002/0167363 A1 11/2002 Yang et al.
2010/0124890 A1 5/2010 Schwarzmueller et al.

FOREIGN PATENT DOCUMENTS

EP 1448021 A2 8/2004
EP 1688016 B1 9/2007
WO 2008/087585 A2 7/2008

OTHER PUBLICATIONS

International Search Report with Written Opinion for PCT/EP2011/060087 dated Apr. 17, 2012.
Sheng-Fu Hsu et al, "Dependence of Device Structures on Latchup Immunity in a High-Voltage 40-V CMOS Process with Drain-Extended MOSFETS", IEEEE Transactions on Electron Devices, 2007.

* cited by examiner

*Primary Examiner* — Suhan Ni
(74) *Attorney, Agent, or Firm* — Sughrue Mion, PLLC

(57) ABSTRACT

A hearing aid comprising a wireless transceiver (100) having an inductive antenna (101) and a trimming capacitor (104, 105, 300, 404) with at least two parallel signal paths, wherein at least one of said signal paths comprises a first capacitor (309, 310, 311, 312), a second capacitor (301, 302, 303, 304) and a switching transistor (305, 306, 307, 308) arranged such that the switching transistor (305, 306, 307, 308) is coupled in parallel with said first capacitor (309, 310, 311, 312) and coupled in series with said second capacitor (301, 302, 303, 304), whereby the voltage drop across the switching transistor (305, 306, 307, 308), when the switching transistor is set to off, will be lower than the voltage applied across the trimming capacitor (104, 105, 300, 404) due to voltage division between said first capacitor (309, 310, 311, 312) and said second capacitor (301, 302, 303, 304). The invention also provides a method of fitting a wireless transceiver (100) for a hearing aid.

17 Claims, 3 Drawing Sheets

HEARING AID WITH A WIRELESS TRANSCEIVER AND METHOD OF FITTING A HEARING AID

RELATED APPLICATIONS

The present application is a continuation-in-part of application PCT/EP2011060087, filed on 17 Jun. 2011, in Europe, and published as WO 2012171573 A1.

BACKGROUND OF THE INVENTION

1. Field of the Invention

The present invention relates to hearing aids. The invention more specifically relates to hearing aids having a wireless transceiver with improved transmission range. The invention also relates to a method of fitting a hearing aid comprising a wireless transceiver.

In the context of the present disclosure, a hearing aid should be understood as a small, microelectronic device designed to be worn behind or in a human ear of a hearing-impaired user. A hearing aid system may be monaural and comprise only one hearing aid or be binaural and comprise two hearing aids. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer. The signal processor is preferably a digital signal processor. The hearing aid is enclosed in a casing suitable for fitting behind or in a human ear.

As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to the receiver placed in the earpiece in the ear. Such hearing aids are commonly referred to as Receiver-In-The-Ear (RITE) hearing aids. In a specific type of RITE hearing aids the receiver is placed inside the ear canal. This is known as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This type is known as Completely-In-Canal (CIC) hearing aids. This type of hearing aid requires an especially compact design in order to allow it to be arranged in the ear canal, while accommodating the components necessary for operation of the hearing aid.

In some hearing aid types a wireless link is provided between the two hearing aids of a binaural hearing aid system. In this case an inductive wireless link is particularly advantageous because the power consumption can be very low over such small distances. Further, since the hearing aids of the binaural hearing aid system are adapted to be worn in or at a left and right ear of a hearing aid user, it is advantageous to employ an inductive wireless link because the magnetic field signals transmitted by the inductive wireless link are not significantly attenuated by the head of the hearing aid user.

In yet other types of hearing aids an inductive radio is used to wirelessly communicate with external signal sources or external relay devices, such as a hearing aid remote control or a hearing aid fitting system. In this type of hearing aids the external signal source or the external relay device must be within close range because the transmission range of the inductive radio falls off approximately with the distance raised to the third power and because the availability of electrical power and supply voltage is generally limited in a hearing aid.

2. The Prior Art

EP-B1-1688016 discloses a transceiver for a hearing aid. The transceiver has a trimming capacitor and a coupling capacitor that are implemented as off-chip components.

Generally, off-chip capacitors are advantageous in that they can sustain a higher voltage than on-chip components and disadvantageous with respect to size and cost. Especially it is relatively expensive to trim the off-chip capacitors since this requires use of external equipment such as e.g. a laser. Trimming of the capacitors is generally required in order to compensate deviations of the inductance of the inductive antenna from the nominal value.

In order to further optimize the transceiver performance it is advantageous that the resonance frequency of the transceiver is constant independent on whether the transceiver is transmitting or receiving. Generally, this puts rather strict requirements on the relative dependencies of the capacitance values of the trimming capacitor, coupling capacitor and the input capacitance of the Low Noise Amplifier (LNA) of the wireless transceiver, requirements that can be difficult to meet in practical implementations with the consequence of decreased transceiver performance and consequently higher power consumption if the requirements are not fulfilled.

It has been proposed in the art to use trimming capacitors that can be trimmed digitally, but these are limited in the voltage they can sustain.

It is a feature of the present invention to provide a hearing aid with an improved wireless transceiver, hereby providing a hearing aid with a long wireless transmission range while maintaining a hearing aid that provides relatively inexpensive manufacturing costs and the possibility of adjustment of the resonance circuit of the wireless transceiver during normal operation and without requiring the use of external equipment.

It is still another feature of the present invention to provide an improved method for fitting a hearing aid comprising a wireless transceiver.

SUMMARY OF THE INVENTION

The invention, in a first aspect, provides a hearing aid comprising a wireless transceiver; wherein said transceiver comprises a trimming capacitor; wherein said trimming capacitor comprises at least two parallel signal paths; wherein at least one of said signal paths comprises a parallel capacitor, a series capacitor and a switching transistor arranged such that the switching transistor is coupled in parallel with said parallel capacitor; and wherein said switching transistor and parallel capacitor are coupled in series with said series capacitor, whereby any voltage drop across the switching transistor, when the switching transistor is set to "off", will be lower than the voltage applied across the trimming capacitor due to voltage division between said parallel capacitor and said series capacitor.

This provides a hearing aid with an improved wireless transceiver.

The invention, in a second aspect, provides a method of fitting a hearing aid comprising a wireless transceiver comprising the steps of digitally setting, in transceiver transmission mode, the modes of a multiplicity of switching transistors, arranged in a trimming capacitor, such that a resonance condition is induced in the transceiver at a selected frequency; digitally setting, in transceiver receiving mode, the modes of said multiplicity of switching transistors, such that a resonance condition is induced in the transceiver at said selected frequency; and digitally increasing, in transceiver transmission mode, the output power from the wireless transceiver when the hearing aid is in fitting mode.

This provides an improved method of fitting a hearing aid comprising a wireless transceiver.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
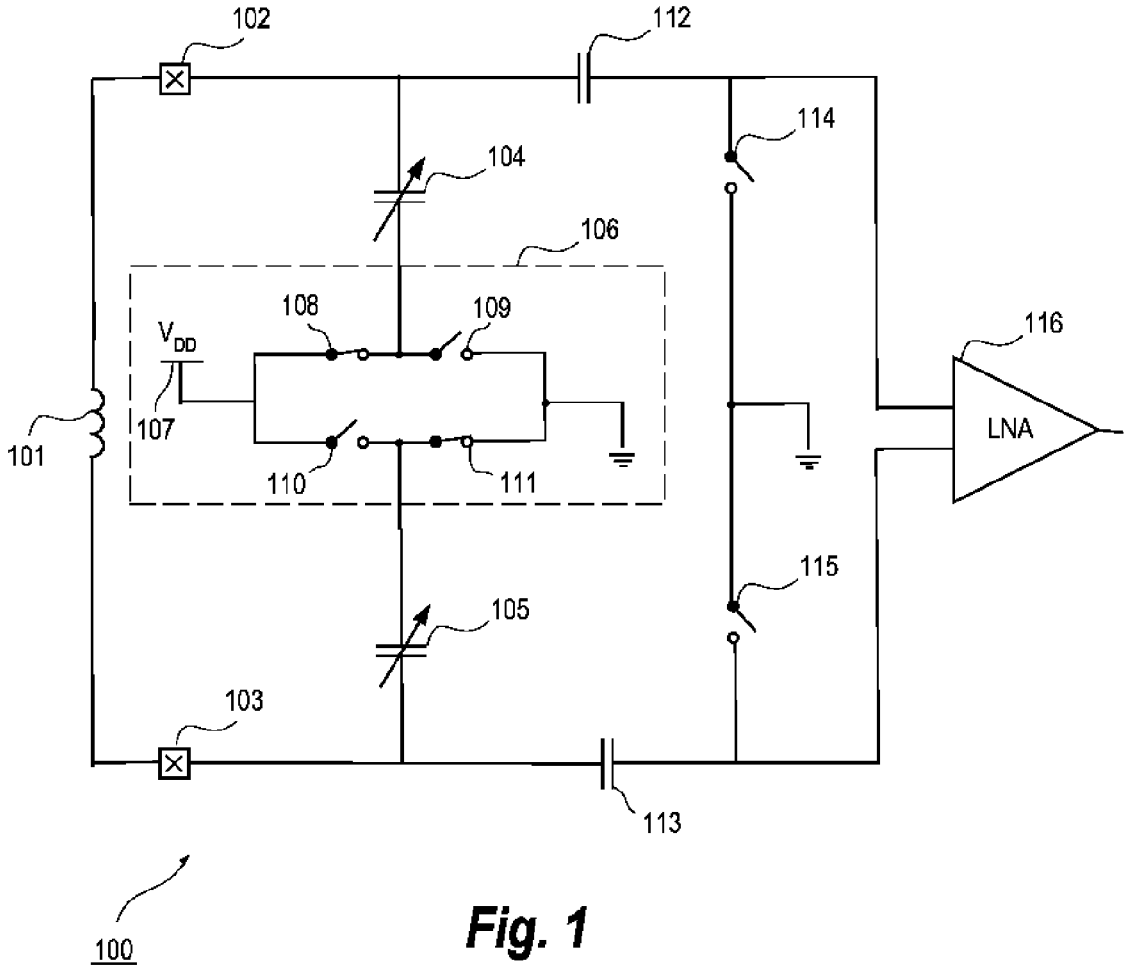
FIG. 1 illustrates highly schematically a wireless differential transceiver for a hearing aid according to an embodiment of the invention.

Reference is first made to FIG. 1, which illustrates highly schematically a wireless transceiver for a hearing aid according to an embodiment of the invention.

The transceiver 100 comprises an inductive antenna 101, a first pad 102 and a second pad 103 adapted for connecting the antenna 101 with the on-chip components of the transceiver 100, a first and a second trimming capacitor 104 and 105, a switching arrangement 106 comprising a DC voltage supply 107 and first, second, third and fourth switch transistors 108, 109, 110 and 111, a first and a second coupling capacitor 112 and 113 and corresponding first and second coupling switch transistors 114 and 115, and a Low Noise Amplifier 116.

The switching arrangement 106 is controlled by a logic controller (not shown) such that the current provided by the voltage supply 107 is alternately directed clockwise and anticlockwise through the resonance circuit of the transceiver when the transceiver is in transmission mode. Hereby the DC voltage of the voltage supply 107 is effectively transformed into an AC voltage, across the antenna 101 and the trimming capacitors 104 and 104, with a frequency that is controlled by the logic controller in a simple manner. The logic controller sees to this by switching the transistors on/off with the desired frequency and arranging the switching transistors such that the first 108 and the fourth 111 transistors are switched on/off synchronously and the second 109 and third 110 transistors are also switched on/off synchronously in such a way that the states of the second and third transistors 109 and 110 are always the opposite of the states of the first and fourth transistors 108 and 111. Further the first and second coupling switch transistors 114 and 115 are set to "on" when the transceiver 100 is in transmission mode, whereby the LNA 116 is protected because current flowing through the coupling capacitors 112 and 113 is directed to ground through the coupling switch transistors 114 and 115 instead of being directed to the LNA 116.

The trimming capacitors 104 and 105 are adapted to ensure that the resonance frequency of the transceiver 100 corresponds to the desired value.

Therefore the trimming capacitors 104 and 105 are adapted to compensate the effect of manufacturing tolerances of the components constituting the resonance circuit of the transceiver, wherein the variation of the inductance of the inductive antenna 101 is the primary concern. It is a specific advantage of the digital implementation of the trimming capacitors that the adjustment of the transceiver resonance circuit can be carried out during normal operation and without requiring the use of external equipment.

In the following the term nominal capacitance of the trimming capacitors 104, 105 denotes the capacitance value that is designed to correspond with the nominal value of the inductance of the inductive antenna 101.

Furthermore the trimming capacitors 104 and 105 can be adapted to compensate for the varying resonance requirements in response to whether the transceiver 100 is in transmission or reception mode.

According to the embodiment of FIG. 1 each of the coupling capacitors 112 and 113 has a capacitance value that is a factor of 10 smaller than the nominal capacitance of each of the corresponding trimming capacitors 104, 105 and a factor of 10 larger than the input capacitance of the LNA 116. Hereby the negative impact, from the coupling capacitors 112 and 113, on transceiver performance can be kept low in both transmission and reception mode, while only requiring adjustment of the trimming capacitors 104 and 105 over a limited range in response to the operation mode of the transceiver.

In a method embodiment according to the invention, the values of the trimming capacitors 104 and 105 are adjusted in response to the operation mode of the transceiver whereby the requirements to the relative values of the coupling capacitors 112 and 113 and the input capacitance of the LNA can be relaxed or even eliminated.

Specifically this can be achieved by digitally setting, in transceiver transmission mode, the values of the trimming capacitors 104 and 105, such that a resonance condition is induced in the transceiver at a selected frequency, and digitally setting, in receiving mode, the values of the trimming capacitors 104 and 105, such that a resonance condition is also induced in the transceiver at said selected frequency, in receiving mode.

In a variation of that method embodiment said selected frequency is the carrier frequency of the wireless transceiver.

In further variations of the embodiment of FIG. 1 the nominal capacitance value of each of the coupling capacitors 112 and 113 is smaller than the nominal capacitance of the corresponding trimming capacitor 104, 105 by a factor in the range between 5 and 15, preferably between 8 and 12. In further variations the nominal capacitance value of each of the coupling capacitors 112 and 113 is larger than the capacitance of the input capacitance of the LNA 116 by a factor in the range between 5 and 15, preferably between 8 and 12.

When the transceiver 100 is in receiving mode, the voltage supply 107 is disconnected by setting the first 108 and third 110 transistor switches to off. Further the trimming capacitors 104 and 105 are engaged by setting the second 109 and fourth 111 switch transistors to "on" and the first 114 and second 115 coupling switch transistors to "off" in order to direct the received signal to the low noise amplifier 116.

The trimming capacitors 104 and 105 can be implemented in a number of different ways as will be further described below.

Figure 2:
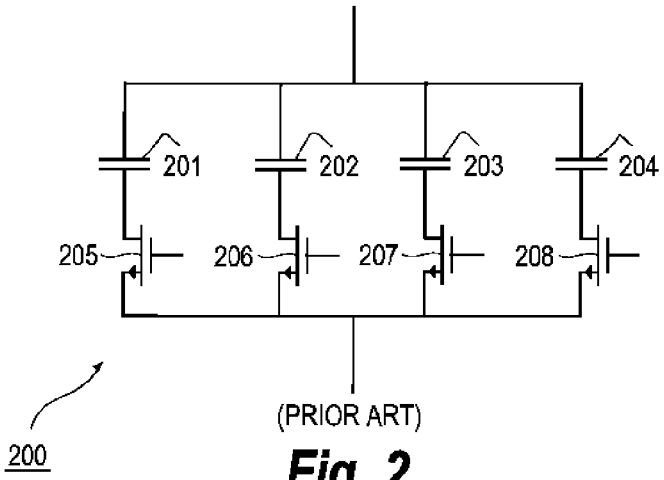
(PRIOR ART) Fig. 2
FIG. 2 is a schematic of a prior art trimming capacitor.

Reference is now made to FIG. 2, which is a schematic of a prior art digital trimming capacitor 200. The trimming capacitor 200 comprises first, second, third and fourth capacitors 201, 202, 203 and 204 and first, second, third and fourth switching transistors 205, 206, 207 and 208 that are controlled by a logic controller (not shown). Each of the capacitors 201, 202, 203 and 204 are coupled in series with a corresponding one of the first, second, third and fourth switching transistors 205, 206, 207 and 208, and each of the signal paths, which comprises a respective series coupled capacitor and a respective switching transistor, are coupled in parallel. The capacitors are selected such that the capacitance value of the first capacitor is two times the value of the second capacitor, four times the third capacitor and eight times the fourth capacitor. If a capacitance value of 10 pF is selected for the first capacitor, the capacitance of the trimming capacitor can be varied between zero and 19 pF dependent on the selected states of the switching transistors, and the total capacitance of the trimming capacitor is 19 pF.

Considering the trimming capacitor 200 of the prior art it can be seen that the full voltage across the trimming capacitor 200 will be applied across a switching transistor in case the switching transistor is set to "off". This is disadvantageous because traditional switching transistors are severely restricted with respect to the voltage they can sustain and this, in turn, limits the magnitude of the voltage that can be applied across the inductive antenna 101 of the transceiver 100 because the resonant circuit of the wireless transceiver is primarily formed by the inductive antenna 101 and the trimming capacitors 104 and 105 and the voltage swing across the inductive antenna 101 at resonance is therefore matched by a corresponding voltage swing, with the opposite sign, across the trimming capacitors 104 and 105.

Figure 3:
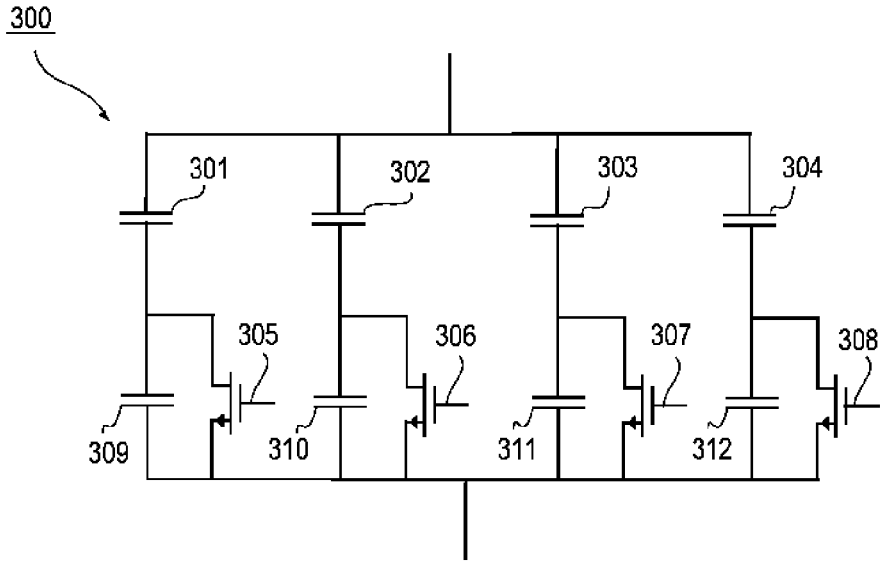
FIG. 3 is a schematic of a trimming capacitor according to an embodiment of the invention.

Reference is now made to FIG. 3, which is a schematic of a trimming capacitor 300 according to an embodiment of the invention. The trimming capacitor 300 comprises first, second, third and fourth capacitors 301, 302, 303 and 304, first, second, third and fourth switching transistors 305, 306, 307 and 308 and fifth, sixth, seventh and eight capacitors 309, 310, 311 and 312.

Each of the capacitors 309, 310, 311 and 312 are coupled in parallel with a corresponding one of the first, second, third and fourth switching transistors 305, 306, 307 and 308 and the thus parallel coupled components are coupled in series with a corresponding one of the first, second, third and fourth capacitors 301, 302, 303 and 304. The first, second, third and fourth capacitors 301, 302, 303 and 304 can therefore in the following be denoted series capacitors and the fifth, sixth, seventh and eight capacitors 309, 310, 311 and 312 can in the following be denoted parallel capacitors.

The capacitors are selected such that the capacitance value of the first capacitor 301 is two times the value of the second capacitor 302, four times the third capacitor 303 and eight times the fourth capacitor 304. The capacitance value of each of the fifth, sixth, seventh and eight capacitors are two times that of the respective capacitor with which each is coupled in series. Hereby the voltage across the switching transistors 305, 306, 307 and 308, when set to "off", is reduced by a factor of one plus the ratio of the capacitance of one of the parallel coupled capacitors 309, 310, 311 and 312 relative to the corresponding series coupled capacitor 301, 302, 303 and 304.

According to the embodiment of FIG. 3 a capacitance value of 10 pF is selected for the first capacitor 301. Hereby the capacitance of the trimming capacitor 300 can be varied between 13 pF and 20 pF dependent on the selected states for the switching transistors. The total capacitance required to form the trimming capacitor 300 is 56 pF. This provides a trimming capacitor that is advantageous in its capability of allowing the magnitude of the voltage across the trimming capacitor 300 to be increased and disadvantageous with respect to the prior art with respect to available trimming range and the total amount of capacitance required to form the trimming capacitor.

Therefore the wireless transceiver 100 of FIG. 1 can allow the voltage swing across the inductive antenna 101 to be increased by up to a factor of three without damaging any of the switching transistors by using the trimming capacitor 300 described in FIG. 3 instead of e.g. the prior art trimming capacitor 200 of FIG. 2.

In variations of the embodiment of FIG. 3 the capacitance value of the largest parallel capacitor 309 is in the range between 15 pF and 25 pF.

In variations of the trimming capacitor according to FIG. 3 other ratios than two can be used to determine the capacitance of the parallel coupled capacitors 309, 310, 311 and 312 relative to the corresponding series coupled capacitor 301, 302, 303 and 304. If e.g. a larger ratio is selected, the critical voltage across the switching transistors 305, 306, 307 and 308, when set to "off", can be reduced at the cost of requiring a larger total capacitance and a smaller tuning range. According to specific variations said ratio is in the range between 1.5 and 4.

In a further variation of the trimming capacitor 300 a signal path of the trimming capacitor comprises at least two sets of a parallel coupled capacitor and a switching transistor arranged such that the two sets are coupled in series. Hereby the voltage across the switching transistors, when set to off, is reduced through simple voltage division. However, this variation is disadvantageous with respect to the embodiment of FIG. 3 in that it requires a higher value of the total capacitance and consequently also requires more space.

In order to improve transceiver performance it is generally desirable to increase either the area of the cross-section of the inductive antenna or the number of windings. Due to the drive towards miniaturization in modern hearing aids the latter is normally preferred. However, the inductance of the inductive antenna increases with the number of windings and as a consequence hereof the resonance capacitance to be provided by the trimming capacitor decreases accordingly. In order for the resonance capacitance to be well above Printed Circuit Board (PCB) and pad parasitic capacitances the inductance of the inductive antenna must be kept lower than a certain value that also depends on the selected transceiver resonance frequency. According to the embodiment of FIG. 1 the inductance of the inductive antenna 101 is 30 uH.

According to variations of the embodiment of FIG. 1 the inductance of the inductive antenna is in the range between 25 and 40 uH.

Further the number of windings determines the resistance of the resonance circuit and therefore also impacts the magnitude of both the current through and the voltage across the inductive antenna during resonance.

In order to optimize transmission efficiency while at the same time ensuring sufficient bandwidth for the wireless transmissions from and to a hearing aid, it is desirable that the resonance circuit of the transceiver, according to the embodiment of FIG. 1, is designed to have a Q-factor of 25.

According to variations of the embodiment of FIG. 1 the resonance circuit of the transceiver is designed to have a Q-factor in the range between 15 and 35, preferably between 20 and 30.

This is achieved by selecting an appropriate value for the resonance (or carrier) frequency of the transceiver 100, and as a consequence of these design choices the nominal capacitance values of the trimming capacitors 104, 105 follow directly. According to the embodiment of FIG. 1 a carrier frequency of 10 MHz has been selected.

According to variations of the embodiment of FIG. 1 the carrier frequency is in the range between 5 and 15 MHz.

According to the embodiment of FIG. 1 the DC voltage of the voltage supply 107 is 1.2 Volt and as a direct consequence hereof the maximum voltage that can be supplied across the inductive antenna 101 is about 30 Volt peak (or 60 Volt peak to peak).

Therefore, in the embodiment according to FIG. 1, the voltage across the pads 102, 103 and the trimming capacitors 104 and 105 spans the range of +/−15 Volt.

Therefore, in case the improved trimming capacitor of FIG. 3 is implemented in the embodiment according to FIG. 1, this means that the voltage across the fifth, sixth, seventh and eight capacitor 309, 310, 311 and 312 of the improved trimming capacitor of FIG. 3 is +/−5 Volt while the voltage at the drain of the first, second, third and fourth switching transistor 305, 306, 307 and 308, when set to off, will be in the range of 0-10 Volt due to the rectifying properties of the switching transistors 305, 306, 307 and 308.

Standard switching transistors cannot sustain such high voltages and at least three different solutions to this problem exist, each of which will be further described below.

According to variations of the embodiment of FIG. 1, the voltage across the switching transistors of the trimming capacitors is reduced by reducing the current through and the voltage across the inductive antenna 101. This can be achieved by reducing the DC voltage supplied by the voltage supply 107, by regulating the duty cycle provided by the switching arrangement 106 or by coupling a voltage reducing capacitor in parallel with the inductive antenna 101. However, common to these solutions is that they are disadvantageous in that the current through and the voltage across the inductive antenna 101 is reduced and thereby the transmission range of the transceiver. Note though that in cases where transmission range is not critical it can be desirable to reduce the current through and the voltage across the inductive antenna in order to reduce the power consumption in the hearing aid.

According to another variation of the embodiment of FIG. 1 the voltage across the individual switching transistors can be reduced by including in each of the parallel signal paths of the trimming capacitors at least two sets of a parallel coupled capacitor and a switching transistor arranged such that the two sets are coupled in series.

However this solution is disadvantageous in that it requires a significant amount of space due to the large value of the total capacitance required to implement the trimming capacitor in this manner.

In still other variations the switching transistors can be implemented in non-standard high voltage processes, but these processes typically requires additional process steps and are therefore relatively expensive.

In yet another variation of the embodiment of FIG. 1 the switching transistors of the trimming capacitors according to FIG. 3 are implemented as drain extended transistors (DEMOS or DENMOS), whereby the voltage across the switching transistors can be increased by up to a factor of three compared to standard CMOS switching transistors, even though the drain extended transistors can be implemented in a standard CMOS process, such as the 0.18 um process, and without requiring additional process steps.

It therefore turns out, according to a specifically advantageous embodiment of the invention, that by implementing a trimming capacitor, as described with reference to FIG. 3 in a transceiver as described with reference to FIG. 1, using drain extended switching transistors, it becomes possible to realize a digitally trimmable hearing aid transceiver that can supply a voltage of more than 50 Volt peak to peak across the inductive antenna, without the use of external capacitors and using only standard CMOS processes for manufacturing.

Further details concerning the manufacturing of drain extended transistors in a standard CMOS process can be found e.g. in the book "High voltage devices and circuits in standard CMOS technologies" and in the article by Sheng-Fu Hsu et al: "Dependence of Device Structures on Latchup Immunity in a High-Voltage 40-V CMOS Process With Drain-Extended MOSFETs" published in IEEE TRANSACTIONS ON ELECTRON DEVICES, 2007.

According to a method embodiment of the invention, the output power of the wireless transceiver is increased in fitting mode, where the hearing aids are required to transmit acknowledgement signals to an external unit, that is typically positioned farther, from each of the hearing aids, than the distance between the two hearing aids in a binaural hearing aid system, wherein said distance defines the standard operating condition of the hearing aid system. In a variation the output power of the wireless transceiver is increased digitally by regulating the duty cycle provided by the switching arrangement 106.

Figure 4:
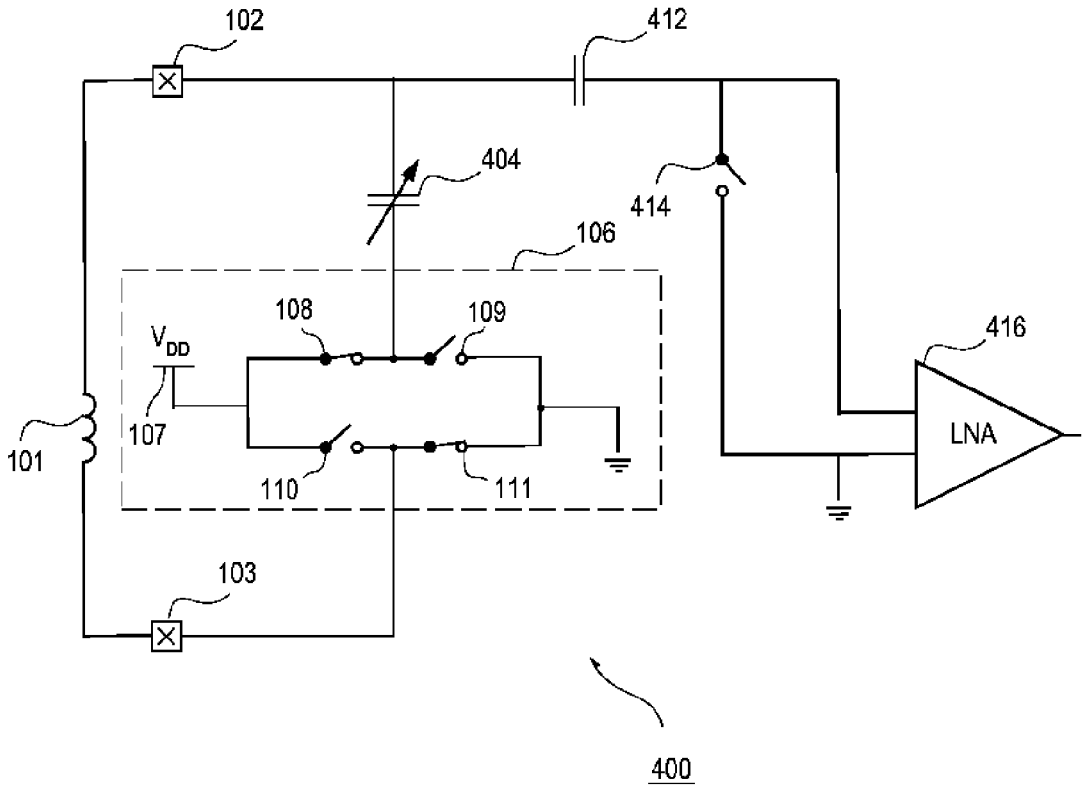
FIG. 4 illustrates highly schematically a wireless single-ended transceiver for a hearing aid according to an embodiment of the invention.

Reference is now made to FIG. 4, which illustrates highly schematically a single ended wireless transceiver 400 for a hearing aid according to an embodiment of the invention.

The transceiver 400 comprises an inductive antenna 101, a first pad 102 and a second pad 103 adapted for connecting the antenna 101 with the on-chip components of the transceiver 400, a first trimming capacitor 404, a switching arrangement 106 comprising a DC voltage supply 107 and first, second, third and fourth switch transistors 108, 109, 110 and 111, a first coupling capacitor 412, a corresponding first coupling switch transistor 414 and a single ended Low Noise Amplifier 416.

According to an embodiment the switching arrangement 106 is controlled in the manner already described with reference to FIG. 1, wherein the first coupling transistor 414 replaces the coupling transistors 114 and 115 of FIG. 1.

According to an alternative embodiment the switching arrangement 106 can in transmission mode be operated by setting the third transistor 110 to "on" and the fourth transistor 111 to "off", while switching on/off the first and second transistors 108 and 109 such that the states of these two transistors are always the opposite of each other.

The single ended transceiver 400 is advantageous in that less capacitance is required for the trimming capacitor and disadvantageous in that it must be capable of sustaining a voltage that is twice the voltage of the differential transceiver.

Other modifications and variations of the structures and procedures will be evident to those skilled in the art.

I claim:

1. A hearing aid comprising a wireless transceiver;

wherein said transceiver comprises a trimming capacitor having at least four parallel signal paths;

wherein each of said four signal paths comprises a parallel capacitor, a series capacitor and a switching transistor arranged such that the switching transistor is coupled in parallel with said parallel capacitor and said switching transistor and parallel capacitor are coupled in series with said series capacitor, whereby any voltage drop across the switching transistor, when the switching transistor is set to "off", will be lower than the voltage applied across the respective trimming capacitor due to voltage division between said the respective parallel capacitor and said the respective series capacitor.

2. The hearing aid according to claim 1; wherein each said switching transistor is a drain extended MOS transistor or NMOS transistor.

3. The hearing aid according to claim 2; wherein each said switching transistor is manufactured in a 0.18 um standard CMOS process.

4. The hearing aid according to claim 1; wherein the inductance of the inductive antenna is in the range between 25 and 40 uH.

5. The hearing aid according to claim 1; wherein the carrier frequency of the wireless transceiver is in the range between 5 and 15 MHz.

6. The hearing aid according to claim 1; wherein the capacitance of said parallel capacitor exceeds the capacitance of said series capacitor by a factor in the range between 1.5 and 4.

7. The hearing aid according to claim 1; wherein, in each of the signal paths, the capacitance of the respective parallel capacitor exceeds the capacitance of the respective series capacitor by a factor in the range between 1.5 and 4.

8. The hearing aid according to claim 1; wherein said parallel capacitors are selected such that the capacitance values of the parallel capacitors in consecutive signal paths increase with a first factor in the range between 1.5 and 4, whereby the capacitance value of the parallel capacitor in a first signal path is larger than the capacitance value of the parallel capacitor in a second signal path by said first factor and the capacitance value of the parallel capacitor in said second signal path is larger than the capacitance value of the parallel capacitor in a third signal path by said first factor and the capacitance value of the parallel capacitor in said third signal path is larger than the capacitance value of the parallel capacitor in the fourth signal path by said first factor.

9. The hearing aid according to 8; wherein said series capacitors are selected such that the capacitance values of the series capacitors in consecutive signal paths increases with a second factor in the range between 1.5 and 4, whereby the capacitance value of the series capacitor in a first signal path is larger than the capacitance value of the series capacitor in a second signal path by said second factor and the capacitance value of the series capacitor in said second signal path is larger than the capacitance value of the series capacitor in a third signal path by said second factor and the capacitance value of the series capacitor in said third signal path is larger than the capacitance value of the series capacitor in the fourth signal path by said second factor.

10. The hearing aid according to claim 9; wherein said first factor and said second factor are identical.

11. The hearing aid according to 1, wherein the capacitance value of the largest parallel capacitor is in the range between 15 and 25 pF.

12. A microelectronic device comprising a wireless transceiver; wherein said transceiver comprises a trimming capacitor having at least four parallel signal paths, each path comprising a parallel capacitor, a series capacitor and a switching transistor arranged such that the switching transistor is coupled in parallel with said parallel capacitor and said switching transistor and parallel capacitor are coupled in series with said series capacitor, whereby any voltage drop across each said switching transistor, when the switching transistor is set to "off", will be lower than the voltage applied across the respective trimming capacitor due to voltage division between said the respective parallel capacitor and said the respective series capacitor.

13. The microelectronic device according to claim 12; wherein said switching transistor is a drain extended MOS transistor or NMOS transistor.

14. The microelectronic device according to claim 12; wherein the capacitance of said parallel capacitor exceeds the capacitance of said series capacitor by a factor in the range between 1.5 and 4.

15. The microelectronic device according to claim 12; wherein, in each of the signal paths, the capacitance of the respective parallel capacitor exceeds the capacitance of the respective series capacitor by a factor in the range between 1.5 and 4.

16. The microelectronic device according to claim 12; wherein said parallel capacitors are selected such that the capacitance values of the parallel capacitors in consecutive signal paths increases with a first factor in the range between 1.5 and 4, whereby the capacitance value of the parallel capacitor in a first signal path is larger than the capacitance value of the parallel capacitor in a second signal path by said first factor and the capacitance value of the parallel capacitor in said second signal path is larger than the capacitance value of the parallel capacitor in a third signal path by said first factor and the capacitance value of the parallel capacitor in said third signal path is larger than the capacitance value of the parallel capacitor in the fourth signal path by said first factor.

17. The microelectronic device according to 16; wherein said series capacitors are selected such that the capacitance values of the series capacitors in consecutive signal paths increases with a second factor in the range between 1.5 and 4, whereby the capacitance value of the series capacitor in a first signal path is larger than the capacitance value of the series capacitor in a second signal path by said second factor and the capacitance value of the series capacitor in said second signal path is larger than the capacitance value of the series capacitor in a third signal path by said second factor and the capacitance value of the series capacitor in said third signal path is larger than the capacitance value of the series capacitor in the fourth signal path by said second factor.

* * * * *